US005985802A

United States Patent [19]

Watari et al.

[11] Patent Number: 5,985,802

[45] Date of Patent: Nov. 16, 1999

[54] HIGH-PERFORMANCE LUBRICANT OIL

[76] Inventors: Koji Watari, Sunhaitsu Chuodai F-306, 5-1 Shiroyama 1-chome, Komaki, Aichi; Hae Jin Hwang, 1-1-202, Meijo 3-chome, Kita-ku, Nagoya, Aichi; Motohiro Toriyama, 3-1 Chuodai 6-chome, Kasugai, Aichi; Akira Osuka, c/o K.K. Fuji Enterprize, Azafuruichiba 38, Oazahaguro, Inuyama, Aichi; Osamu Yamamoto, Azadaimon 4-1, Inuyama, all of Japan

[21] Appl. No.: 09/089,321

[22] Filed: Jun. 2, 1998

[30] Foreign Application Priority Data

Jun. 2, 1997 [JP] Japan ..... 9-159173

[51] Int. Cl.[6] ..... C10M 125/26

[52] U.S. Cl. ..... 508/155; 72/42

[58] Field of Search ..... 508/155; 72/42

[56] References Cited

U.S. PATENT DOCUMENTS

| | | | |
|---|---|---|---|
| 4,202,523 | 5/1980 | Radtke | 508/155 |
| 4,612,128 | 9/1986 | Uematsu et al. | 508/431 |
| 5,141,659 | 8/1992 | Kashiwaya et al. | 508/155 |
| 5,437,802 | 8/1995 | Kurahashi et al. | 508/116 |
| 5,460,737 | 10/1995 | Sakai et al. | 508/220 |
| 5,541,144 | 7/1996 | Wildenbarg | 508/220 |
| 5,819,572 | 10/1998 | Krajewski | 508/155 |

OTHER PUBLICATIONS

A Dictionary of Mining, Mineral, and Related Terms; p. 126 1968.

*Primary Examiner*—Jerry D. Johnson
*Attorney, Agent, or Firm*—Morrison & Foerster LLP

[57] ABSTRACT

An inexpensive high-performance cutting or grinding oil capable of significantly improving the cutting efficiency. Into a liquid component of the cutting or grinding oil are dispersed fine powders of boron nitride of hexagonal system and/or crystal line turbostratic structure, particularly crystalline turbostratic structure, having a mean particle size of primary particles not larger than 1 $\mu$m.

18 Claims, 5 Drawing Sheets h-BN

MEDIAN SIZE = 0.304 μm
SPECIFIC SURFACE=234287cm²/cm³

PARTICLE SIZE: 1.00 μm=95.2 %
%PARTICLE SIZE: 90.0 %=0.747 μm

×20,000

×10000

INDICATED MULTIPLICATION FACTOR $\times \frac{2}{3}$

HIGH-PERFORMANCE LUBRICANT OIL

TECHNICAL FIELD OF THE INVENTION

This invention relates to a high-performance lubricant oil used for wet machining, such as milling or drilling, wet grinding by a grinding wheel, or wet polishing inclusive of mechano-chemical polishing (MCP) of a workpiece, such as an inorganic material, e.g., metals or ceramics, compound materials thereof or fiber-reinforced materials thereof. The lubricating liquids or lubricants in general are termed herein as "lubricant oil".

BACKGROUND

The lubricant oil used for machining, also herein termed cutting oil, is admixed with sulfur-based extreme-pressure additives or chlorine-based extreme-pressure additives. However, if the cutting oil admixed with sulfur-based extreme pressure additives or chlorine-based extreme pressure additives is used for machining materials difficult to cut, such as Inconel, the tool has a short service life, such that the tool exchange time is sometimes longer than the cutting time. On the other hand, if the workpiece difficult to cut, such as Inconel, is bored by a cemented carbide drill, only a few holes at most can be bored with a sole drill.

In machining a soft material, poor in thermal resistance and mold releasing properties, cutting chips remain loaded to the cutting edge of the tool thus lowering machining precision and yield. Since it is necessary in this case to lower the machining speed to prevent the temperature from increasing or to exchange the tools frequently. If the tool is exchanged frequently, the productivity is lowered. Thus, in boring an aluminum material, as an example, the number of revolutions of the drill needs to be suppressed to a lower value of the order of several hundred revolutions per minute.

In cutting oils, for which thermal resistance is also a requirement, those admixed with graphite or molybdenum disulfide, as solid lubricants, are sometimes used. However, the thermal resistance of graphite or molybdenum disulfide is 500 to 600° C., such that, if this temperature is exceeded, loading occurs frequently to lower the machining yield. Although the lubricating performance may be improved to a certain extent with the conventional cutting oil admixed with molybdenum disulfide or graphite, it is not possible to realize significant improvement in the operating efficiency or machining precision or in durability, such that definite limits are set in improving productivity or in reducing the machining cost.

Boron nitride (BN), a compound composed of boron and nitrogen, has many different forms having substantially the same crystal structures as carbon. Carbon exists as amorphous carbon, graphite of the hexagonal structure having a laminated structure of hexagonally-shaped meshed layers, and diamond of the cubic system. Of these, graphite of the hexagonal system, having a laminated structure of hexagonal meshed layers, and exhibiting significant cleavage characteristics at the inter-layer portions, exhibits the solid lubricating performance. Boron nitride also is known to have different forms, such as amorphous boron nitride (referred to herein as a-BN), boron nitride of the hexagonal system having a laminated structure of hexagonal-shaped meshed layers at a repetitive period of two layers (referred to herein as h-BN), rhombohedral structure having a laminated structure of hexagonal-shaped meshed layers at a repetitive period of three layers (referred to herein as r-BN), a turbostratic boron nitride having randomly layered hexagonal-shaped meshed layers (referred to herein as t-BN) and a high pressure phase cubic born nitride of the cubic structure (referred to herein as c-BN).

The h-BN crystals are known to exhibit cleavage characteristics, comparable to those of graphite crystals of the hexagonal system, and hence optimum solid lubricating properties. The lubricating properties of the h-BN crystals are presumably ascribable to the Van-Del-Waals bond with a weak bond between the two-dimensional hexagonal meshed layers comparable to that of graphite. That is, the crystals exhibit significant cleavage characteristics along this plane such that crystal grains cleft in flakes between the layers are liable to slip relative to one another.

A sintered mass of h-BN powders of high purity is colorless to white in color, superior in electrical insulating properties, higher in resistance against oxidation than graphite, less liable to be reacted with and melted into ferrous materials like graphite and are less apt to suffer burning to the ferrous materials because of a reduced ractivity with the ferrous material. In this regard, h-BN is a suitable material as a solid lubricant material.

As a typical case of exploiting the lubricating properties of h-BN, JP Patent Kokai JP-A-63-135496 discloses a lubricant oil excellent in thermal resistance and in friction reducing effect, obtained by dispersing in a fluid oil and fat h-BN powders and polyether ketone powders both of which are not larger than 20 $\mu$m in the mean particle size. On the other hand, JP Patent Kokai JP-A-01-318087 discloses lubricant oil which is excellent in lubricating properties and in sliding performance and which is obtained on mixing and dispersing in e.g., silicone oil h-BN powders with a particle size of 2 to 10 $\mu$m and used for drawing steel wires etc.

On the other hand, the a-BN powders are hygroscopic and unstable and hence are not suited as boron nitride powders admixed to the lubricant oil, so that h-BN powders, exhibiting no hygroscopicity, are predominantly used. However, the h-BN powders are costly and hence are used only for special application in which cost increase is tolerable. As far as the present inventors have searched, there is no instance of use of cutting oils or grinding oils admixed with the boron nitride powders. It is noted that r-BN or t-BN has barely reached the stage of tentative manufacture in a laboratory such that discussions of the practical usage are thought to be of no avail.

In the Journal of the Shigen-Sozai Gakkai (Society of Resources and Materials), vol.1. 105, No.2, p.201, 1988, a-BN is explained as being t-BN. However, the powder X-ray diffraction diagram by CuK$\alpha$ rays of boron nitride powders, termed t-BN therein, demonstrates only two broad lines of diffraction at the positions of [100] and [101] neighboring to a diffraction peak [002] of h-BN, while not demonstrating or scarcely demonstrating the diffraction peak at the position of the diffraction peak [004]. In the present specification, the position of the diffraction peak in the powder X-ray diffraction diagram of boron nitride powders is represented as an index of the diffraction peaks characteristic to h-BN for convenience of explanation. This powder X-ray diffraction diagram is similar to that for a-BN shown in FIG. 1. Therefore, it is not proper to assume that a-BN be the same as t-BN.

SUMMARY OF THE DISCLOSURE

It is a basic object of the present invention to provide a high performance lubricant oil (that is, a lubricating liquid), superior in cost performance, and which is used for cutting, grinding and/or polishing.

It is another object of the present invention to provide a novel machining method for a workpiece employing this high performance lubricant oil.

Further objects of the present invention will become apparent in the entire disclosure.

In one aspect of the present invention, the high performance lubricant oil of the present invention comprises, in its liquid component, an effective amount of fine powders of boron nitride of turbostratic structure.

In a second aspect, the present invention provides a high-performance lubricant oil for cutting, grinding and/or polishing characterized in that it contains in a dispersed state in its liquid component fine powders of boron nitride of the hexagonal system and/or the crystalline turbostratic structure, in particular the crystalline turbostratic structure, having a mean particle size of primary particles not larger than 1 $\mu$m.

In a third aspect, the present invention provides a method for machining a workpiece comprising machining the workpiece using a lubricating liquid containing an effective amount of boron nitride powders of the crystalline turbostratic structure.

In a fourth aspect, the present invention provides a method for machining a workpiece comprising machining the workpiece using a lubricating liquid containing in a liquid component an effective amount of boron nitride powders of the hexagonal system and/or the crystalline turbostratic structure having a mean particle size of primary particles of 1 $\mu$m or less.

In the present invention, the crystalline boron nitride, having a developed two-dimensional crystal structure, demonstrating a sharp diffraction peak at the [004] position and not demonstrating or scarcely demonstrating any diffraction peak at the [102] position characteristic of h-BN, is termed crystalline t-BN.

The meritorious effects of the present invention are briefly stated as follows.

With the conventional technique for synthesizing boron nitride, there lacked a mass-producing method of high yield not only with respect to crystalline t-BN fine particles but also with respect to h-BN powders. Thus, the h-BN powders were costly so that the application to the lubricant oil was limited to extremely limited usage. However, with establishment of the above-described synthetic technique, not only the h-BN powers, but also crystalline t-BN fine powders superior in solid lubricating properties could be mass-produced inexpensively. Encouraged by establishment of the above-described synthetic technique, the present inventors attempted to apply the powders of boron nitride to a new field of usage hitherto unknown, that is the application as an additive to the cutting, or grinding oil, and have ascertained that outstanding effects cain be obtained by addition of fine powders of boron nitride. That is if the cutting oil according, to the present invention is used for grinding, the cutting tool can be improved in durability, at the same time as the working efficiency can be improved significantly thus improving the production yield and reducing the machining cost. Also, the working efficiency can be significantly improved using the same lubricant oil as that used for cutting for grinding, thus testifying to outstanding merits of the cutting oil and the grinding oil according to the present invention for industry.

In the following the preferred embodiments will be described with reference to the drawings for better illustration.

DESCRIPTION OF THE PREFERRED EMBODIMENTS

Figure 1:
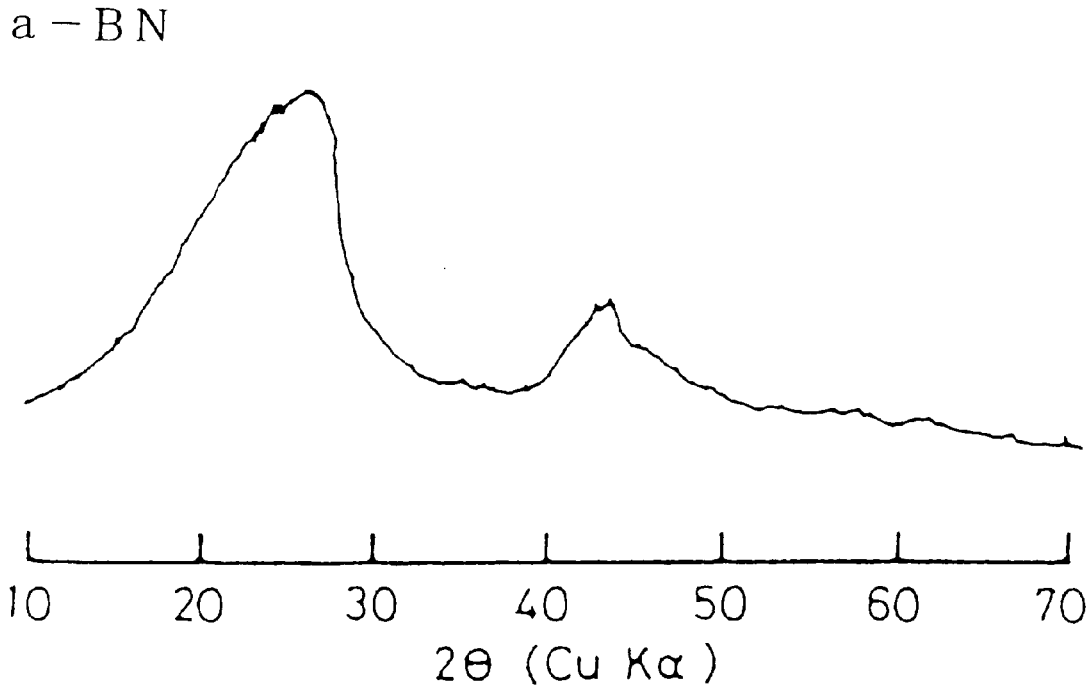
FIG. 1 is a powder X-ray diffraction diagram of an example of conventional a-BN fine powders.
Figure 2:
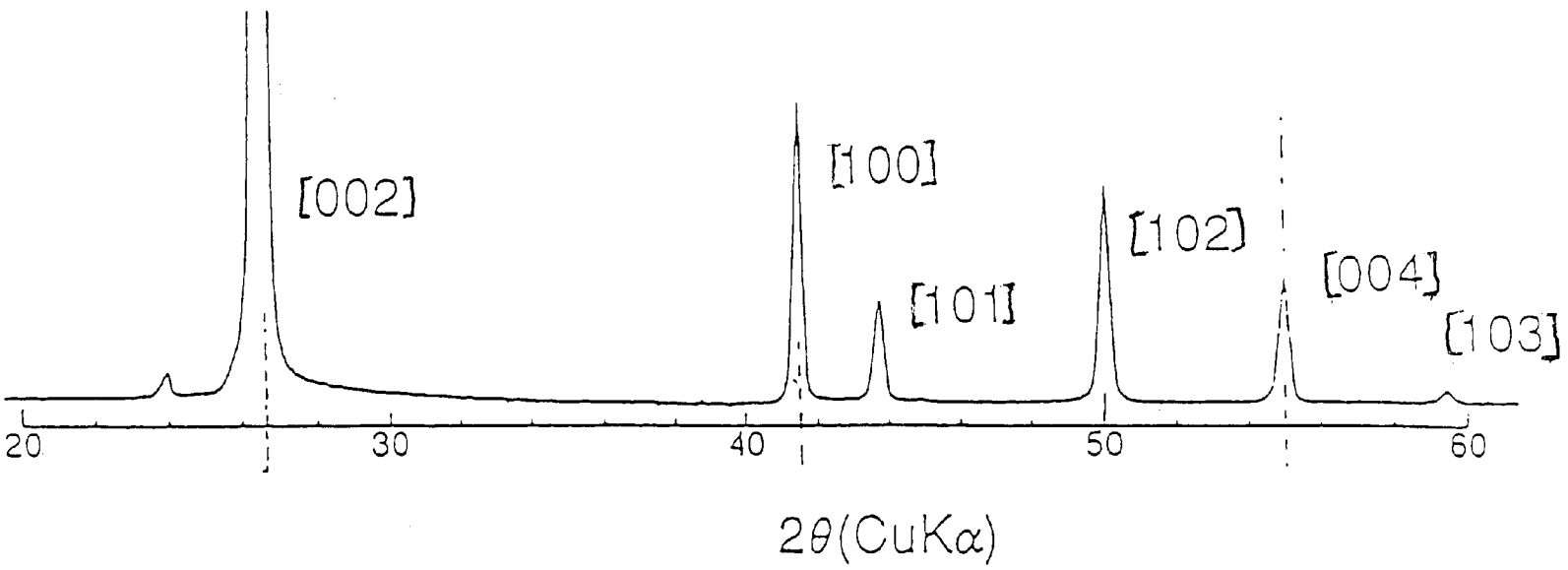
FIG. 2 is a powder X-ray diffraction diagram of an example of conventional h-BN fine powders.
Figure 3:
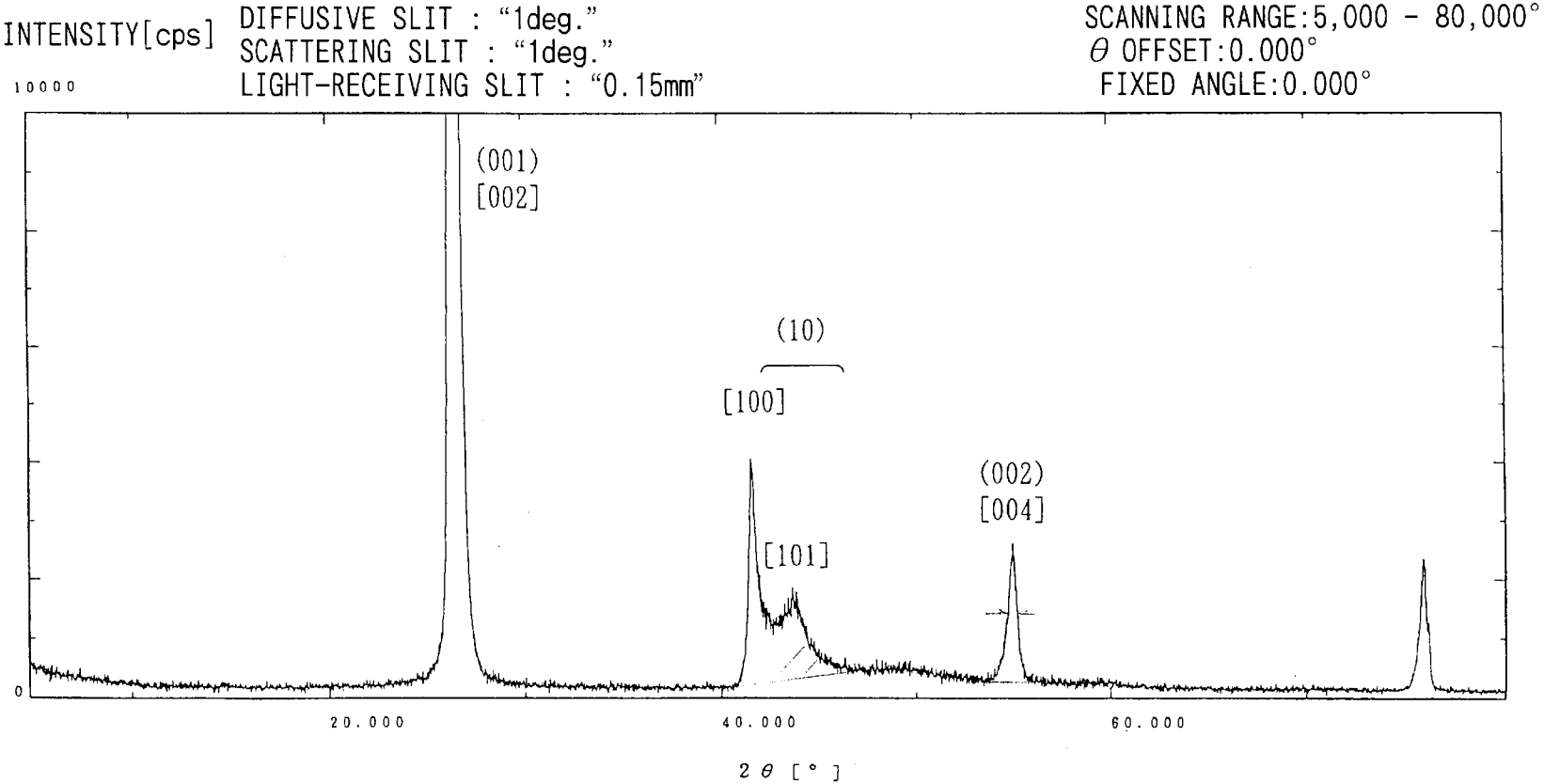
FIG. 3 is a powder X-ray diffraction diagram of an example of crystalline t-BN fine powders admixed to the cutting oil and the grinding oil of the present invention.

Boron nitride has a feature that it is chemically stable as compared to other solid lubricants, such as graphite, and is not oxidized up to approximately 1000° C. in air. FIGS. 1, 2 and 3 show powder X-ray diffraction diagrams of typical a-BN powders, h-BN powders and crystalline t-BN fine powders, respectively. If boron nitride is synthesized at a lower temperature not higher than 900° C., a-BN powders showing two broad diffraction peaks at a position of [002] of h-BN and at a position corresponding to neighboring [100] and [101] positions are obtained. It is said that, if these a-BN powders are heat-treated at a temperature higher than 1050° C., crystallization is initiated. With progress in crystallization, the diffraction peak corresponding to the [002] diffraction peak of h-BN is changed to a diffraction peak with a smaller half-value width and a sharp peak. At this time, the [004] diffraction peak presents itself simultaneously as a sharp diffraction peak having a small half-value width.

The fine powders of crystalline t-BN can be synthesized at a high yield by heating a mixed starting material of boric anhydride and urea, optionally containing boric acid salt of alkali such as sodium borate, in a reaction vessel kept to a non-oxidizing atmosphere, carrying out a reaction at a temperaure not higher than approximately 1100° C., (preferably not higher than 950° C.), for yielding a-BN, and carrying out heating in the co-existence of sodium borate at a temperature not lower than 1200° C. and not higher than 1500° C. (preferably 1200 to 1400° C., more preferably 1250° C. to 1350° C.) for crystallizing t-BN. The resulting reaction product is purified by washing with water, preferably with hot water, (if necessary also with acid), for removing soluble components such as alkali or boron oxide, fine powders of crystalline t-BN with a mean particle size of primary particles not larger than 1 $\mu$m can be manufactured at a high yield inexpensively in larger quantities. With the above-described synthesis method, the particle size of the primary particles can be varied by changing the time and temperature for crystallization thus synthesizing powders of boron nitride comprised of co-existing h-BN and crystalline t-BN fine powders. This novel synthesizing method is explained in our co-pending JP-Patent Application 9-21052 and corresponding U.S. patent application Ser. No. 09/089, 018, the entire disclosure of which is incorporated by reference to the present application.

The crystalline t-BN fine powders, synthesized and purified as described above, are usually secondary particles formed on agglomeration of fine primary particles of a submicron size. However, if these particles are dispersed in a liquid, the majority of the particles are turned into primary particles of crystalline t-BN fine particles in a dispersed state. If necessary the dispersion can be disintegrated and separated into fine primary particles with a mean particle size not larger than 1 μm (preferably not larger than 0.5 μm, not larger than 0.3 μm, not larger than 0.2 μm and further not larger than 0.1 μm) by wet pulverization using an attrition mill or a ball mill employing ceramic beads or balls, such as zirconia beads, as pulverization media, or a roll-type shearing type mill having two or three rolls, or a dry pulverization, employing a jet mill. These crystalline t-BN fine powders are not hygroscopic, in distinction from the a-BN powders, and are also stable.

With the manufacturing method of the present invention, similar particle size distribution can be realized with h-BN such that crystalline fine powders of boron nitride partially containing h-BN and which predominantly are comprised of crystalline t-BN can be mass-produced, too. Conversion to h-BN can be industrially realized by further heat-treating crystalline t-BN for a pre-set time duration at a temperature of 1500° C. or above.

Both the h-BN powders and crystalline t-BN fine powders are composed of crystalline particles exhibiting cleavage characteristics. These h-BN powders and crystalline t-BN fine powders, in particular the crystalline t-BN fine powders, exhibit superior solid lubricating properties. The reason the fine powders of boron nitride disporsed in the high performance lubricant oil for cutting or grinding in the particular aspect of the present invention is that the finer the fine particles of boron nitride crystals, the more easily can the particles enter narrow spatial interstices to fully display the function as a lubricant oil or as a grinding oil. The mean particle size of the primary particles of boron nitride powders dispersed into the liquid component is preferably not larger than 0.5 μm and more preferably not larger than 0.3 μm. In particular, the submicron size primary particles of crystalline t-BN, if forming secondary particles, are not so strong in the agglomerating power, and are easily disintegrated into primary particles or secondary particles of smaller particle sizes under the shearing force applied during machining, such as grinding. Therefore, the function as the lubricant oil can be achieved in a majority of cases by employing primary particles of smaller particle size. It may be premeditated that the particle size of the primary particles of not larger than 7 μm may roughly be sufficient for general grinding purposes.

As the fine powders of boron nitride, fine powders of boron nitride, containing 50 wt % or more of crystalline t-BN fine powders, dispersed in a liquid ingredient, are preferred. The crystalline fine powders of t-BN according to the present invention comprise those in the advanced stage of two-dimensional crystallization, having sharp diffraction peaks with a small half-value width of the diffraction line at the [002] position and the [004] position of the h-BN crystals (with the half-value width of the [004] diffraction peak represented by 2θ of the powder X-ray diffraction diagram obtained with the CuKα rays being 0.6 degrees or less), exhibiting no or scarcely any [102] diffraction peak proper to the h-BN crystals representing periodic ordering of the laminated structure, and having one diffraction peak ([10] of t-BN) unified from the [100] diffraction peak and [101] diffraction peak of t-BN. The fact that the X-ray diffraction peak of a pattern in which the high angle side of the t-BN [10] diffraction peak is gradually decreased means that the crystalline t-BN is of a turbostratic (disturbed layer) structure exhibiting no periodic ordering in the laminating manner (pattern) of the hexagonal meshed layers although it is in an advanced stage of the two-dimensional crystallization. The crystalline t-BN fine powders according to the present invention may be typically numerically defined by S102/(S100+S101+S102)≦0.02 wherein S100, S101 and S102 denote areas occupied by the respective diffraction peak lines of the powder X-ray diffraction diagram corresponding to the diffraction spectra [100], [101] and [102] of the powder t-BN fine powders.

As the crystalline t-BN fine powders dispersed in the liquid ingredient of the cutting oil, it is preferred to use those obtained on wet dispersion using a medium having good dispersibility, such as alcohol, having a mean particle size as secondary particles of not larger than 7 μm (further not larger than 4 μm, not larger than 2 μm and more preferably not larger than 1 μm). During use for cutting or grinding, the lubricant oil undergoes progressively the communication of secondary particles to increase the proportion of fine primary particles to exhibit progressively superior lubricating properties. Therefore, the lubricant oil in the initial stage may be such a lubricant oil in which powders of boron nitride dispersed contain a large quantity of secondary particles. The crystalline t-BN fine powders, employed in the present invention, preferably exhibit highly uniform particle size component for the primary particles with the mean particle size of not larger than 0.5 μm , not larger than 0.3 μm and further not larger than 0.2 μm.

Although the crystalline t-BN fine powders exhibit lubricating properties as dry fine powders, the fine powders are bulky and difficult to handle so that it is difficult to feed the fine powders to local areas for cutting or grinding. Therefore, the fine powders are mixed with a liquid component and dispersed in this mixed state. Of course, BN can be stored in the powder form and dispersed as a mixture into liquid batchwise or continuously. As the liquid ingredient of the cutting oil or the grinding oil, polar or non-polar liquids, aqueous or non-aqueous liquid or a mixture or an emulsion thereof may be used. For example, petroleum, synthetic oil, vegetable oil, water, oil/water suspensions or organic solvents may be used. It suffices if an optimum liquid component or liquid component is selected depending on the object and condition of the particular application.

The lubricant oil may be a fluid liquid suspension containing a large quantity of the liquid component or a grease-like liquid suspension containing a small amount of the liquid component. For uniformly dispersing fine powders of boron nitride, such as crystalline t-BN fine powders, in the liquid component, it is preferred to mix a dispersant or a surfactant at the time of mixing the fine powders into the liquid component to agitate the resulting mixture at a high rpm, using a homogenizer, knead the mixture with a roll or to pulverize the powders along with the liquid ingredient in a ball mill or an attrition mill under the action of the shearing force. The lubricant oil is preferably formulated in the state of thick liquid suspensions for storage and used in a diluted state in order to avoid the bulky state during transport or storage. On use, the lubricant oil of the present invention preferably contains the crystalline t-BN fine powders or h-BN fine powders in the dispersed state in the primary particles or in the state in which the powders can be easily dispersed in the primary particles.

Although the reason that the cutting oil or the grinding oil having the crystalline t-BN fine powders with the developed crystalline structure suspended therein exhibits superior lubricating properties as compared to the lubricant oil having fine powders of h-BN crystals suspended therein is not quite clear, it is presumed that at least the difference in the inter-layer ordering is mainly responsible for the difference displayed. It is noted that h-BN has a high ordering whereas the crystalline t-BN fine powders have basically irregular or random. Specifically, it may be presumed that the bonding strength between the hexagonal meshed layers of the crystalline t-BN fine powders is lower than that between the hexagonal meshed layers of h-BN crystals to cause interlayer slip or cleavage such that the flake-shaped crystals exhibiting cleavage characteristics tend to slip in a direction parallel to the layers because of the lack of orientation in the direction parallel to the hexagonal meshed layers of the crystal. It may also be presumed that the primary particles of the synthesized crystalline t-BN fine powders are fine in particle size and hence the powders tend to function as a solid lubricant. It is noted that the primary powders are obtained as fine powders of secondary particles with a mean particle size of not larger than 10 μm composed of fine primary particles with the mean particle size of not larger than 1 μm to not larger than 0.3 μm or not larger than 0.2 μm.

Depending on the crystallization temperature of a-BN synthesized at lower temperatures lower than 1200° C., preferably 1100° C. or below, and more preferably 950° C. or below, fine powders of boron nitride exhibiting various degrees of crystallization are obtained. It is noted that t-BN crystallization occurs at a temperature not lower than 1200° C. and lower than 1500° C., preferably at a temperature of 1200° C. to 1400° C. and more preferably 1300° C.±50° C. If the temperature is raised further for proceeding the crystallization, boron nitride ultimately is converted to h-BN which is stable at elevated temperatures. The conversion to h-BN from the crystalline t-BN powder starts upon heating at 1450° C. or more, resulting, in a mixture of t-BN and h-BN powders. If the proportion of the crystalline t-BN fine powders in the fine powders of boron nitride dispersed in the cutting or grinding lubricant oil is higher, superior lubricating properties are displayed during machining. For displaying superior lubricating properties, crystalline t-BN fine powders preferably account for not less than 50 wt % (not less than 70 wt %, not less than 80 wt % and more preferably not less than 90 wt %) of fine powders of boron nitride contained in the lubricant oil. The proportion of the crystalline t-BN fine powders in the fine powders of boron nitride can be measured by comparing the intensity of the diffraction spectra obtained on powder X-ray diffraction (area occupied by the diffraction spectra) to the intensity of the powder X-ray diffraction spectra of the standard mixed boron nitride powders having a known mixing proportion.

The finer the fine powders of boron nitride of h-BN or crystalline t-BN, the better is the lubricating effect for a small addition amount. For this reason, the mean particle size of the fine powders of boron nitride in the lubricant oil (particle size of the secondary particles) is preferably not larger than 7 μm, not larger than 4 μm, not larger than 2 μm, and most preferably not larger than 1 μm. If the fine powders of boron nitride are pulverized by a mill, the secondary particles can be dispersed relatively easily to fine powders comprised of fine primary particles. The particle size distribution of the fine powders of boron nitride can be measured by, for example, a precipitation method. The mean particle size specifies the particle size at a position of 50 wt % of the integrated weight in the weight integrated particle size distribution. The mean particle size of the primary particles can be found by measurement on a SEM photo of the fine particles.

There is an optimum economical value of the mixing amount of the fine powders of boron nitride in the cutting oil or in the grinding oil depending on the use condition. The mixing amount of the fine powders of boron nitride in the lubricant oil of 0.1 to 70 wt % is preferred since this range imparts optimum lubricating properties and can cover an extensive working condition. The reason is that with the mixing amount not larger than 0.1 wt %, the lubricating effect accrued is small, whereas, if the mixing amount exceeds 70 wt %, it will become difficult to obtain a homogeneous liquid suspension and fluidity is lost such that it becomes difficult to demonstrate optimum lubricating properties. For demonstrating lubricating properties with optimum cost performance, the mixing amount of the fine powders of boron nitride would be most preferably 0.2 to 50 wt %.

For imparting superior lubricating properties, the primary particles of the fine powders of boron nitride are preferably of a mean particle size not larger than 1 μm, not larger than 0.5 μm, not larger than 0.3 μm or not larger than 0.2 μm. If the mean particle size of the primary particles is not larger than 1 μm, the secondary particles of fine powders are progressively pulverized during use of the lubricant oil to the particle size of the primary particles, even if the secondary particles of the fine powders of boron nitride are larger in the mean particle size, such that superior lubricating properties are progressively displayed during machining even if the initial lubricating properties of the lubricant oil are not sufficient.

Figure 5:
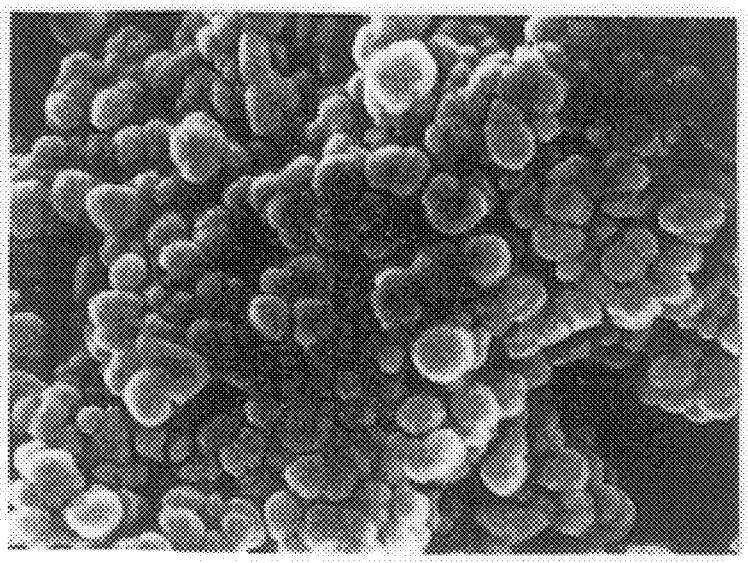
FIG. 5 is an enlarged photo by a scanning microscope (SEM) showing an example of crystalline t-BN fine powders admixed to the cutting oil and the grinding oil of the present invention.
Figure 5:
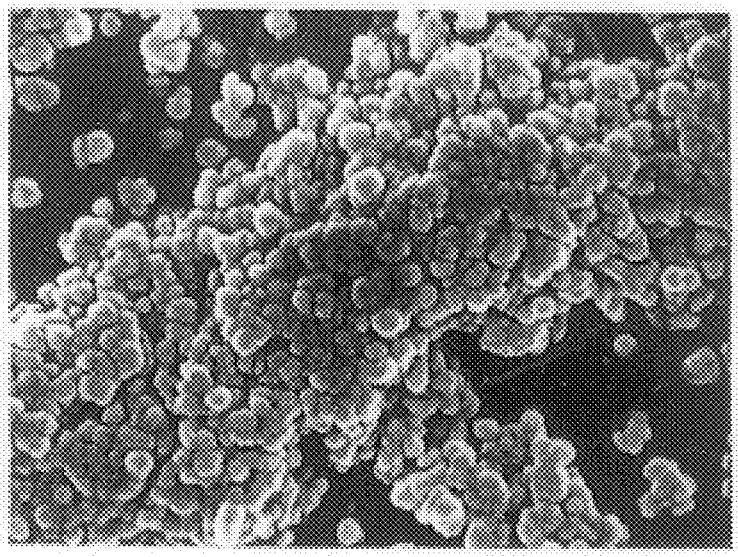

The crystalline t-BN fine powders, having the developed two-dimensional crystalline structure, are substantially disc- or spherically-shaped, as shown in the SEM photo of FIG. 5, and also exhibit superior lubricating properties. Since addition of crystalline t-BN fine powders can impart excellent lubricating properties to the cutting or grinding lubricant oil, not less than 50 wt %, preferably not less than 70 wt % (further not less than 80 wt %, not less than 90 wt % and most preferably substantially all) of the primary particles of the fine powders of boron nitride contained in the lubricant oil of the present invention are substantially disc- or substantially spherically-shaped. Although the primary particles of the crystalline t-BN fine powders are usually of the particle size as small as 1 μm or less, the shape of the primary particles can be observed by a photo of a scanning electronic microscope (SEM). It is noted that the primary particles of the crystalline t-Bn fine powders being not in the form of hexagonally-shaped plates in distinction from the crystal grains of h-BN is presumably ascribable to lack of ordering (or orientation) of the laminating structure between the two-dimensional meshed layers.

The liquid components of the cutting oil or the grinding oil are preferably selected so as to be suited to prevailing use conditions. An example of the liquid component is the petroleum-based oil because it is readily available at low costs on the market. Also, a non-aqueous synthetic oil is preferably used as the liquid component because the characteristics of the liquid component can be controlled intensively. Ester-based oils and fats, including natural oils and fats, are also preferably used because of excellent dispersion characteristics with respect to fine powders of boron nitride.

The liquid component need not necessarily be oil and may also be of an aqueous type depending on the prevailing use conditions. For example, water (aqueous cutting liquid) or a water/oil emulsion may preferably be employed. The emulsion may be an water-in-oil (W/O) emulsion in which water is dispersed in oil, or a water-in-oil type emulsion, in which oil is dispersed in water. Depending on the machining conditions, a water/glycol mixture may also be used as a liquid component of the lubricant oil.

The fine powders of boron nitride cannot be said to be superior in dispersibility with respect to the liquid component. Also, fine powders, agglomerated coarsely, cannot manifest stable and superior lubricating properties even if the powders are fine in particle diameter. In this consideration, it is preferred to add a dispersant for dispersion of fine powders of boron nitride. Nonionic surfactants, anionic surfactants, amphoteric surfactants and oil-soluble surfactants are particularly useful. That is, any surfactant selected from among nonionic surfactants, anionic surfactants, amphoteric surfactants and oil-soluble surfactants is preferably used as the dispersant of the lubricant oil according to the present invention. If the dispersant is added to the lubricant oil, the fine powders can be readily re-dispersed even if the fine particles of the boron nitride crystals are precipitated and isolated due to differential specific gravity. Of the dispersants, amphoteric surfactants and oil-soluble surfactants are most preferred.

In the lubricant oil of the present invention, various additives, other than the dispersants, are preferably added, depending on the use conditions and the type of the liquid component. Examples of the additives include anti-oxidants, viscosity index improvers, fluid point lowering agents, antiseptics, rust-proofing agents, extreme pressure additives, emulsifiers and anti-foaming agents. As these additives, those offered to the market may be used.

If the lubricant oil containing fine particle of boron nitride and the liquid components are supplied as an aerosol, the cutting oil or the grinding oil can be conveniently sprayed to the machining points. The cutting oil or the grinding oil can be used in case of necessity because of facility in use. As an example, the cutting oil or the grinding oil can be charged into an aerosol vessel for being supplied as an aerosol in a packaged state.

EXAMPLES

The present invention will be hereinafter explained with reference to Examples of the cutting or grinding method by the cutting oil or the grinding oil. The examples are, however, merely illustrative because the cutting oil or grinding oil (for machining) are not limited to those given in the following Examples. That is, the present invention can be applied according to its various aspects depending on the conditions in need of lubrication, such as polishing.

Example 1

Manufacture of Crystalline t-BN Fine Powders

The crystalline t-BN fine powders were manufactured by the following method. A mixture of 3.5 kg of boric anhydride, 5.3 kg of urea and 0.63 kg of borax ($Na_2B_2O_3.10H_2O$) was charged into a pressure-resistant hermetically sealable vessel of stainless steel of approximately 12 liters in capacity and raised in temperature up to 900° C. in approximately one hour. This temperature was kept for about 10 minutes to complete the reaction to synthesize a-BN. During this reaction, water and carbonic gas were produced from the reaction system to increase the pressure in the react ion vessel. Thus, the inside of the reaction vessel was filled with a mixed gas of water and carbonic gas with a pressure exceeding 1 atm. The reaction mass looking like caramel (brittle cake) taken out from the reaction vessel was crushed to particles not larger than 1 mm in diameter. The resulting crushed product was charged into an alumina vessel fitted with a lid and the resulting assembly was charged into an electrical furnace maintained at a $N_2$ atmosphere. The crushed product was raised in 10 hours to a temperature of 1300° C. at which temperature it was kept for two hours for conversion to t-BN crystals to yield crystalline t-BN fine powders. During this crystallization, sodium borate co-existing with a-BN acts for accelerating conversion of a-BN to crystalline t-BN fine powders so that the crystalline t-BN fine powders can be synthesized at a high yield. Since impurities such as sodium borate are affixed to the synthesized crystalline t-BN fine powders, the latter are purified by washing with ion-exchanged water at approximately 80° C. to yield 0.63 kg (approximately 70% in yield, calculated as boron) of the crystalline t-BN fine powders.

Figure 4:
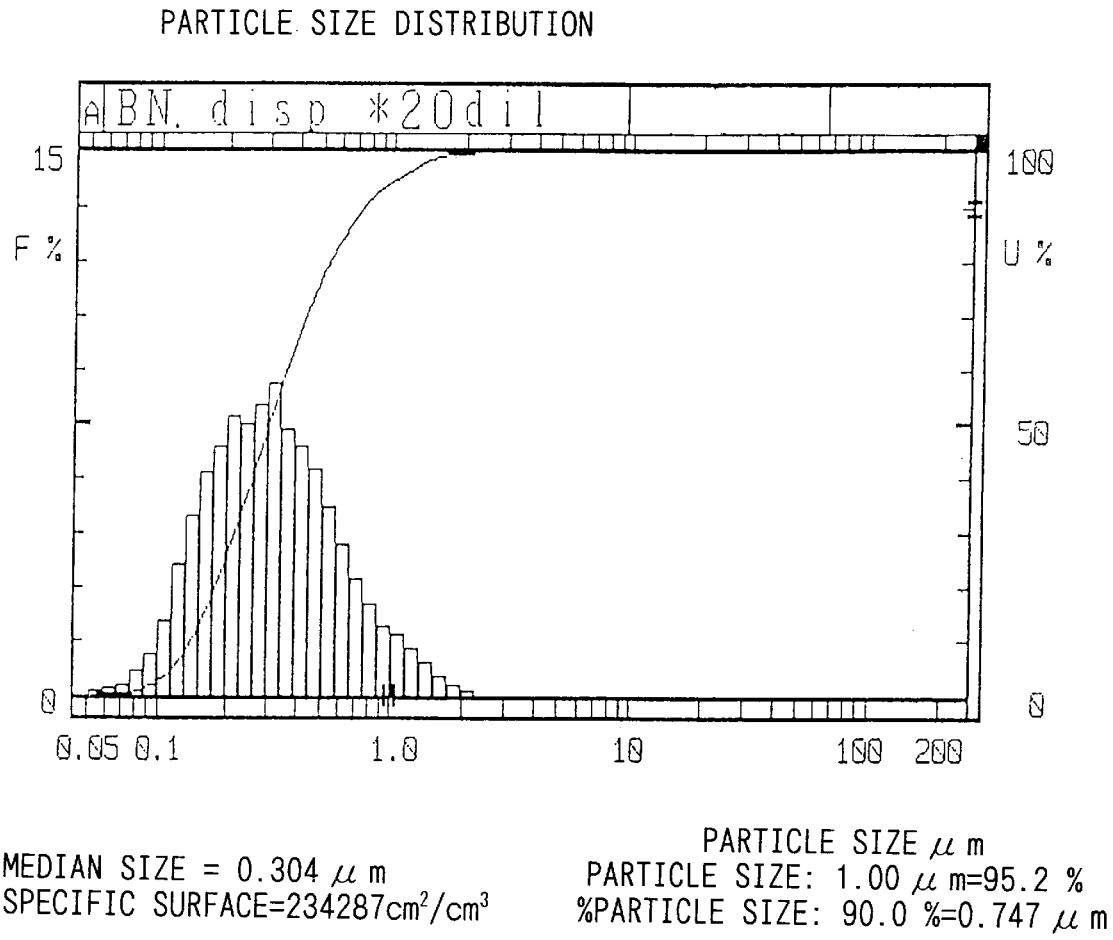
FIG. 4 is a graph showing grain size distribution of an example of crystal line t-BN fine powders admixed to the cutting oil and the grinding oil of the present invention.

FIG. 3 is a powder X-ray diffraction diagram by CuKα rays of the crystalline t-BN fine powders obtained by the above synthesis process. It is seen from the powder X-ray diffraction diagram of FIG. 3 that the half-value width of the diffraction spectrum of t-BN corresponding to the [004] diffraction spectrum of h-BN is approximately 0.5°, there being a shoulder-like swollen-out portion on the high angle side of the [10] diffraction spectrum of boron nitride of the hexagonal system. However, there is observed no spectrum which corresponds to the [102] diffraction spectrum of h-BN. FIG. 4 shows a example of measurement of particle size distribution by precipitation analysis of fine powders obtained on pulverizing the resulting crystalline t-BN fine powders for 24 hours in an alumina pot mill of 7 liter in capacity filled with alumina balls 10 mm in diameter using alcohol as a medium. The results of measurement of the particle size distribution of the crystalline t-BN fine powders revealed that the mean particle size of the fine powders (thought to be data containing yet certain amount of secondary particles) was approximately 0.4 μm. FIG. 5 shows an example of an enlarged photo taken by SEM of the resulting crystalline t-BN fine powders, with a mean particle size of the primary particles as estimated based on this enlarged SEM photo being approximately 0.33 μm.

Example 2

Preparation of Cutting Oil and Cutting Test

The cutting oil was prepared in the following manner: A liquid mixture containing 64 parts by weight of lubricating base oil (petroleum based oil, inflammation point (coc) about 218° C., dynamic viscosity at 40° C. of approximately 27.8 $mm^2/s$ (cSt)) and 6 parts by weight of polyoxyethylene coconut alkylamine derivative (KAO-AMITO 102) was charged into a 7-liter alumina pot mill and mixed at 60 rpm for one hour. Then, 30 parts by weight of crystalline t-BN fine powders were added to the alumina pot mill and the resulting mass was pulverized and mixed together at 60 rpm for 24 hours to yield a homogeneously dispersed liquid suspension of approximately 2 kg of the crystalline t-BN fine powders. This liquid suspension was diluted by a factor of 15 in a commercial nonaqueous cutting oil A (synthetic oil) (Yushiron Cut No.4C manufactured by YUSHIRO KAGAKU KOGYO) to give a cutting oil containing 2 wt % of the crystalline t-BN fine powders. Meanwhile, chlorine-based extreme pressure agent was previously added to the cutting oil A.

The results obtained using this cutting oil for turning SUS440C employing coated cemented carbide tool (EH20Z manufactured by SUMITOMO DENKO KK, with a cutting speed of 125 m/min, feed rate of 0.15 mm/rev and a depth of cut of 0.5 mm, were compared to the results obtained using the commercial non-aqueous cutting oil A. It was found that tool durability with the cutting oil of the present invention could be elongated by a factor of approximately two as compared to the ease of using the commercial non-aqueous cutting oil A and the coated cemented carbide tool for turning stainless steel. The finishing cut surface was better than that obtained using the non-aqueous cutting oil A.

Example 3

Preparation of Cutting Oil and Cutting Test

A liquid mixture obtained on adding 0.4 part by weight of polyoxyethylene coconut alkylamine derivative (KAO-AMITO 102) to 79.6 parts by weight of a non-aqueous synthetic oil (cutting oil B) manufactured by NIPPON SEKIYU KK as a liquid component of the cutting oil was charged into an alumina pot mill of 7-liter capacity and mixed at 60 rpm for one hour. 20 parts by weight of crystalline t-BN fine powders, synthesized under the same conditions as those used in Example 1, were charged into an alumina pot mill of the same capacity and mixed together at 60 rpm for 24 hours to provide a homogeneous liquid suspension. This liquid suspension was diluted by a factor of 15 with the commercial non-aqueous cutting (synthetic) oil A to give a cutting oil containing 1.3 wt % of the crystalline t-BN fine powders.

The results obtained on boring a hole of 10.9 mm in diameter and 30 mm in depth in Inconel on a precision transverse boring machine using this cutting oil and a cemented carbide drill (NEW POINT BRA manufactured by MITSUBISHI MATERIAL KK with a drill rpm of 800, a feed rate of 0.2 mm/rev and a cutting speed of 30 mm were compared to those obtained on boring using the commercial synthetic cutting oil A. It was found that, with the use of the inventive cutting oil, the number of holes that could be bored using a sole cemented carbide drill was not less than twice that in case of boring holes in Inconel with a sole cemented carbide tool using the commercial non-aqueous synthetic cutting oil A. The cut surface of the bored hole was more satisfactory than the cut surface of the bored hole obtained on using the commercial non-aqueous cutting oil A.

Example 4

A mixture containing 67.8 parts by weight of industrial gasoline, 10 parts by weight of crystalline t-BN fine powders manufactured under the same conditions as those of Example 1, 2 parts by weight of petroleum resin powders manufactured by MITSUI SEKIYU KAGAKU KK and 0.2 part by weight of polyoxyethylene coconut alkylamine derivative (KAO-AMITO 102) was charged into an alumina pot mill of 7 liter capacity and mixed together at 60 rpm for eight hours. To 60 parts by weight of this liquid suspension were added 190 parts by weight of LPG and the resulting mass was charged int an aerosol vessel of 420 ml capacity.

A hole of 8 mm in diameter and 19 mm in depth was bored in an aluminum workpiece whilst the cutting oil charged into the aerosol vessel was sprayed onto a cemented carbide drill mounted on a universal boring machine. It was found that, as compared to the case of drill working not spraying the cutting oil, the rpm of the cemented carbide drill could be raised from 600 to 1000 thus significantly improving the cutting efficiency. The cutting surface of the hole obtained using the cutting oil of the present invention was improved in properties over that obtained on cutting without spraying the cutting oil.

Example 5

As the cutting oil, the aerosol vessel used in Example 4 was sprayed onto a working surface of a diamond grinding wheel (grain size #1500 of abrasive grains and diameter of 125 mm), SUS440C was ground with a peripheral speed of the grinding wheel set to 1600 m/sec. It was now found that, as compared to the working conditions of the grinding operation of not spraying the cutting oil, the depth of cut could be increased from 1 μm to 5 μm, while the working efficiency of the grinding operation could be improved by a factor of about three. The rate of consumption speed of the grinding wheel upon grinding using the cutting oil was equivalent to that upon grinding without using the cutting oil. The cutting surface obtained on grinding with spraying of the cutting oil was improved in properties over that obtained without using the cutting oil.

It should be noted that any modifications obvious in the art may be done without departing from the gist and scope of the present invention as disclosed herein and as appended herewith.

What is claimed is:

1. A high-performance lubricant oil for cutting, grinding or polishing comprising a liquid component comprising an effective amount of fine powders of boron nitride of a crystalline turbostratic structure, said effective amount being effective to improve durability and efficiency of said lubricant oil for cutting, grinding or polishing.

2. A high-performance lubricant oil as defined in claim 1, further comprising:

fine powders of boron nitride of the hexagonal system having a mean particle size of not larger than 1 μm.

3. The high-performance lubricant oil as defined in claim 2 wherein at least 50 wt % of fine powders of boron nitride dispersed in the liquid component are fine powders of boron nitride of the crystalline turbostratic structure.

4. The high-performance lubricant oil as defined in claim 1 wherein the mean particle size of the fine powders of boron nitride dispersed in the liquid component is 0.5 μm or less.

5. The high-performance lubricant oil as defined in claim 1 wherein the fine powders of boron nitride are dispersed in the liquid component in an amount of 0.1 to 50 wt %.

6. The high-performance lubricant oil as defined in claim 1 wherein at least 50 wt % of the fine powders of boron nitride dispersed in the liquid component are particles having a particle size of 0.3 μm or less.

7. The high-performance lubricant oil as defined in claim 1 wherein at least 50 wt % of particles of the fine powders of boron nitride as observed by an electron microscope are substantially spherically- or disk-shaped.

8. The high-performance lubricant oil as defined in claim 1 wherein the liquid component comprises petroleum-based oil or synthetic oil.

9. The high-performance lubricant oil as defined in claim 1 wherein the liquid component comprises ester based oil and fat.

10. The high-performance lubricant oil as defined in claim 1 wherein the liquid component is an water-oil emulsion.

11. The high-performance lubricant oil as defined in claim 1 wherein the liquid component is an aqueous liquid.

12. The high-performance lubricant oil as defined in claim 1, wherein a dispersant for the fine powders of boron nitride is added to the liquid component and said dispersant is at least one nonionic surfactant, anionic surfactant, cationic surfactant, amphoteric surfactant or oil-soluble surfactant.

13. The high-performance lubricant oil as defined in claim 1 wherein at least one component selected from the group of anti-oxidants, viscosity index improvers, fluidizing point depressing agents, antiseptics, rust-proofing agents, extreme pressure additives, emulsifiers and anti-foaming agents is added to the liquid component.

14. The high-performance lubricant oil as defined in claim 1 wherein the lubricant oil comprising the fine powders of boron nitride and the liquid component is an aerosol.

15. A high-performance lubricant oil as defined in claim 1, wherein the fine powders of boron nitride of the crystalline turbostratic structure have a mean particle size of not larger than 1 $\mu$m.

16. A method for machining a workpiece comprising providing a lubricating liquid comprising boron nitride powders of a crystalline turbostratic structure, and machining a workpiece using said lubricating liquid.

17. A method for machining a workpiece as defined in claim 16, further comprising:

providing boron nitride powders of a hexagonal structure having a mean particle size of 1 $\mu$m or less in said lubricating liquid.

18. A method for machining a workpiece as defined in claim 16, wherein the fine powders of boron nitride of the crystalline turbostratic structure have a mean particle size of 1 $\mu$m or less.

* * * * *